US006732963B2

(12) United States Patent
Kasada et al.

(10) Patent No.: US 6,732,963 B2
(45) Date of Patent: May 11, 2004

(54) FLOUR MILLING ROLL MACHINE HAVING FRONT DOOR AND ROLL COVER WITH FULCRUM AXES FOR EXPOSING ROLLS EASILY

(75) Inventors: Masaaki Kasada, Tokyo (JP); Shigeki Uebayashi, Tokyo (JP); Makoto Miyaji, Tokyo (JP); Atsushi Fukui, Tokyo (JP); Takeshi Okamoto, Tokyo (JP)

(73) Assignee: Satake Corporation, Tokyo (JP)

( * ) Notice: Subject to any disclaimer, the term of this patent is extended or adjusted under 35 U.S.C. 154(b) by 205 days.

(21) Appl. No.: 10/017,659

(22) Filed: Dec. 12, 2001

(65) Prior Publication Data

US 2002/0074435 A1 Jun. 20, 2002

(30) Foreign Application Priority Data

Dec. 15, 2000 (JP) ..... 2000-382273

(51) Int. Cl.[7] ..... B02C 4/06

(52) U.S. Cl. ..... 241/135; 241/143; 241/167; 241/285.3

(58) Field of Search ..... 241/166, 167, 241/142, 135, 143, 285.3

(56) References Cited

U.S. PATENT DOCUMENTS 4,572,441 A * 2/1986 Sangati ..... 241/34
6,145,767 A * 11/2000 Hostettler ..... 241/135

* cited by examiner

*Primary Examiner*—Mark Rosenbaum
(74) *Attorney, Agent, or Firm*—Wells St. John P.S.

(57) ABSTRACT

The machine comprises a front door, a roll cover having a main roll cover and a feed roll cover, a first fulcrum axis between the main and feed roll covers, and a second fulcrum axis between the feed roll cover and a frame. The front door has a hinge at the upper portion so that it is kept at a self-supporting state when opened. The main roll cover is foldable on the feed roll cover about the first fulcrum axis. The feed roll cover is swung upwardly about the second fulcrum axis and is finally kept at the self-supporting state with the main roll cover folded on the feed roll cover. Where the front door and the roll cover are kept in their self-supporting states, since a pair of rolls and a stock feeder are fully exposed, the remaining stock accumulated in the machine can be removed easily.

6 Claims, 5 Drawing Sheets

FLOUR MILLING ROLL MACHINE HAVING FRONT DOOR AND ROLL COVER WITH FULCRUM AXES FOR EXPOSING ROLLS EASILY

RELATED APPLICATIONS

This application relates to and claims a priority from corresponding Japanese Patent Application No. 2000-382273 filed on Dec. 15, 2000.

BACKGROUND OF THE INVENTION

1. Field of the Invention

The present invention relates to a flour milling roll machine for breaking grains, for example wheat grains, and more particularly to a flour milling roll machine in which remaining stock accumulated in the roll machine can easily be removed at the time of the maintenance after operation.

2. Description of the Related Art

A multiple roll machine used in a flour milling plant is well known. As shown in FIG. 1, the flour milling roll machine 101 of the multiple type has two sets of a pair of rolls 103, 104 within its frame 102. Such multiple roll machine is divided by a center partition board 105 so that two sets of the pair of the rolls 103, 104 operate independently. Also, roll axes 106, 107 are positioned such that a line linking two centers of the roll axes 106, 107 is horizontal, and thus such flour milling roll machine is effective in feeding the stock.

At the time of the maintenance after operation, it is necessary, as a routine operation, to clean and remove the remaining stock accumulated on a feeding hopper 108, a feeder gate plate 109, feeder rolls 110, 111, and a guide chute 112 and a portion between the rolls 103, 104. Such operation in the flour milling roll machine shown in FIG. 1, involves a procedure in which, at first, a side cover (not shown) and an outer door 113 positioned at an upper portion of the frame 102 are removed.

In the conventional flour milling roll machine, the outer door 113 is screwed to the frame 102 by a large number of bolts, and in the same way the side cover is also screwed to the frame 102 by a large number of bolts. When these doors are removed, since there are many bolts, the removing operation consumes a long time and is a troublesome operation. Upon the completion of the removing of the outer door 113 and the side cover from the frame 102, the components such as the feeder gate plate 109, the feeder rolls 110, 111, the guide chute 112 are exposed from an opening portion at the outer door 113. Then an operator puts his arm into the frame 102 through the opening at the outer door 113 and removes the remaining stock accumulated on each feeder component.

Also when the outer door 113 is removed, a roll cover 115 covering the pair of the rolls 103, 104 is exposed. At the time of maintenance, there is a case where the roll cover 115 is also removed. Such roll cover 115 is similarly fixed on the frame 102 by many bolts. Also, since the weight of the roll cover 115 is heavy, about 11 kg and the size thereof is large, for example 1,000×300 mm, the removing operation requires hard labor, and it is also necessary to secure a space around the machine to place the removed cover.

SUMMARY OF THE INVENTION

In view of the above circumstance, an object of the present invention, therefore, is to overcome the problems existing in the prior art, and to provide a flour milling roll machine in which the remaining stock accumulated in the roll machine can easily be removed at the time of maintenance.

According to one aspect of the invention, there is provided a flour milling roll machine having, within a machine frame, at least a pair of rolls which are driven in a different circumference speed between the rolls, a roll gap adjusting means for adjusting a roll gap between the rolls, and a stock feeding means for feeding raw material stock in a thin layer state to the gap between the rolls, the flour milling roll machine comprising:

a front door for covering an opening in the machine frame located at a diagonally upper side of the rolls, the front door having a hinge at its upper edge portion connected to an upper portion of the opening so that it is swung outwardly and upwardly about the hinge and finally is kept at a self-supporting position;

a roll cover divided into a main roll cover for covering over an upper portion of the rolls, and a feed roll cover for covering the stock feeding means;

a first fulcrum axis arranged between the main roll cover and one end of the feed roll cover, the main roll cover being foldable on the feed roll cover about the first fulcrum axis; and a second fulcrum axis arranged between the other end of the feed roll cover and an internal predetermined portion of the machine frame, the feed roll cover being swung outwardly and upwardly about the second fulcrum axis with the main roll cover being kept as the folded state and finally being kept as the self-supporting position, wherein, where the front door is opened in the self-supporting position, the roll cover is exposed; where the main roll cover is folded about the first fulcrum axis over the feed roll cover, a part of upper portions of the rolls is exposed and, further, where the feed roll cover is swung about the second fulcrum axis and is finally kept at the self-supporting position, the entire upper portions of the rolls and the stock feeding means are exposed so that remaining stock accumulated thereon can be removed with ease.

The feed roll cover may have at its tip portion a finger guard with a plurality of long holes which prevents operator's hands from being caught between the rolls.

The flour milling roll machine may further comprise brush scrapers each of which is abutted to a surface of each of the rolls for raking stock adhering to the rolls, the brush scrapers being adjusted if the rolls are glazed when the rolls and the stock feeding means are exposed.

The flour milling roll machine may further comprise a front wall in the frame which is opened during maintenance, the front wall having a hinged portion connected to the frame.

The flour milling roll machine may further comprise a bottom cover which covers a lower portion of one of the rolls and which is opened during maintenance, the bottom cover having a hinged portion connected to the frame.

According to the invention, when the operator opens the front door of the roll machine by swinging the bottom edge of the front door upwardly from the front side so that the door is self-supported, the roll covers covering a pair of the rolls are exposed. At this state, where the main roll cover is first folded toward the feed roll cover and, then, the feed roll cover is swung upwardly with the main roll cover being folded, the feeder gate plate, the front feeder roll, the main roll and the guide chute, which are the components of the stock feeding means, are exposed.

Then, in the case where there is an accumulation of the stock on the periphery of the components such as the feeder gate plate, the front feeder roll and the guide chute, the operator removes such stock by using a cleaning means such as an air compressor and a brush. As above, because of no bolts for fixing the front door and the roll cover to the frame, removing operation of screws which is troublesome and time consuming is not necessary. As a consequence, the maintenance can be finished in a short time and the operation becomes easy.

BRIEF DESCRIPTION OF THE DRAWINGS

The above and other objects, features and advantages of the present invention will be apparent from the following description of a preferred embodiment of the invention explained with reference to the accompanying drawings, in which.

PREFERRED EMBODIMENT OF THE INVENTION

Now, an embodiment according to the invention is explained with reference to the drawings.

Figure 1:
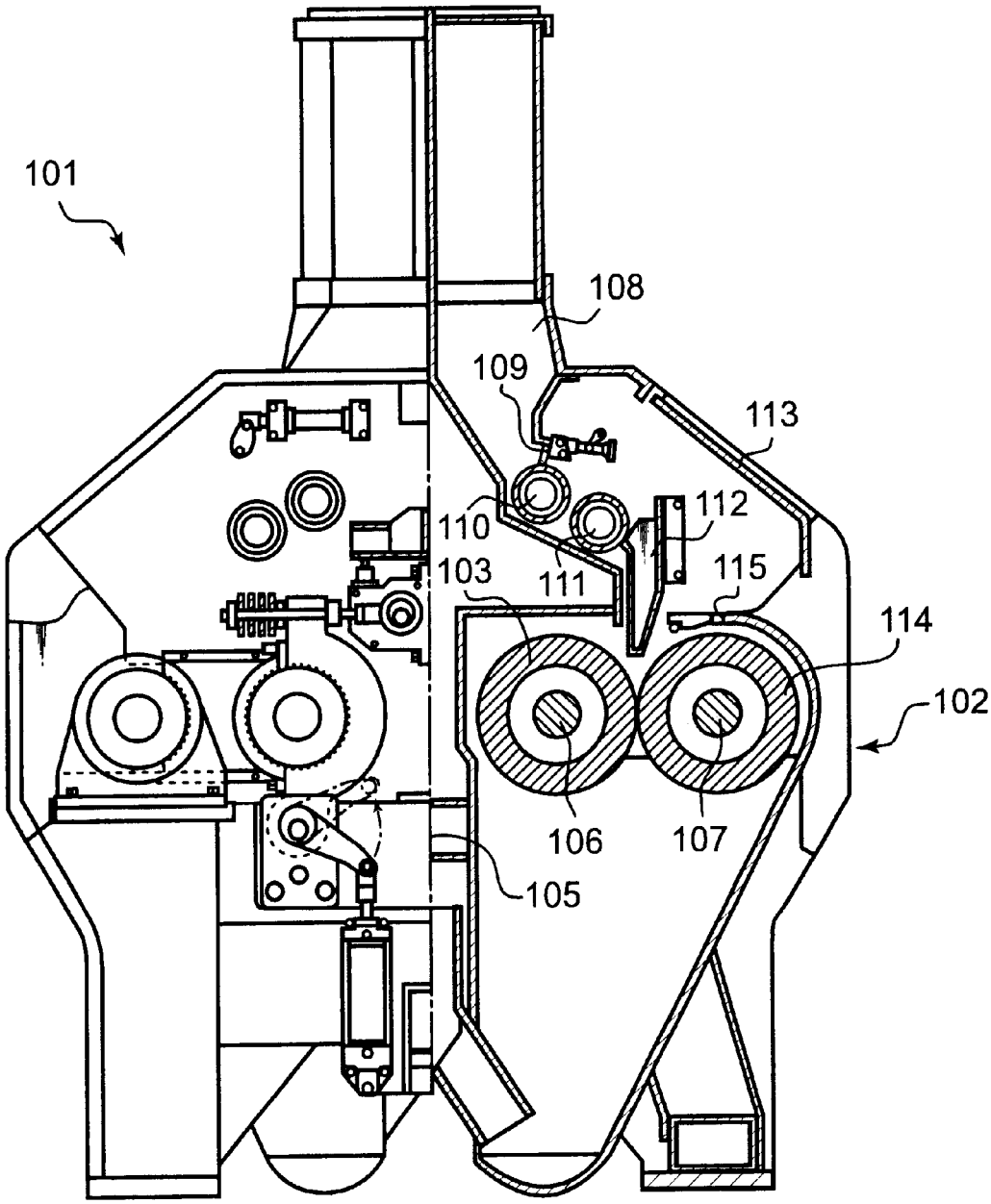
Fig. 1 PRIOR ART
FIG. 1 is a partially cross sectional view showing a conventional flour milling roll machine.
Figure 2:
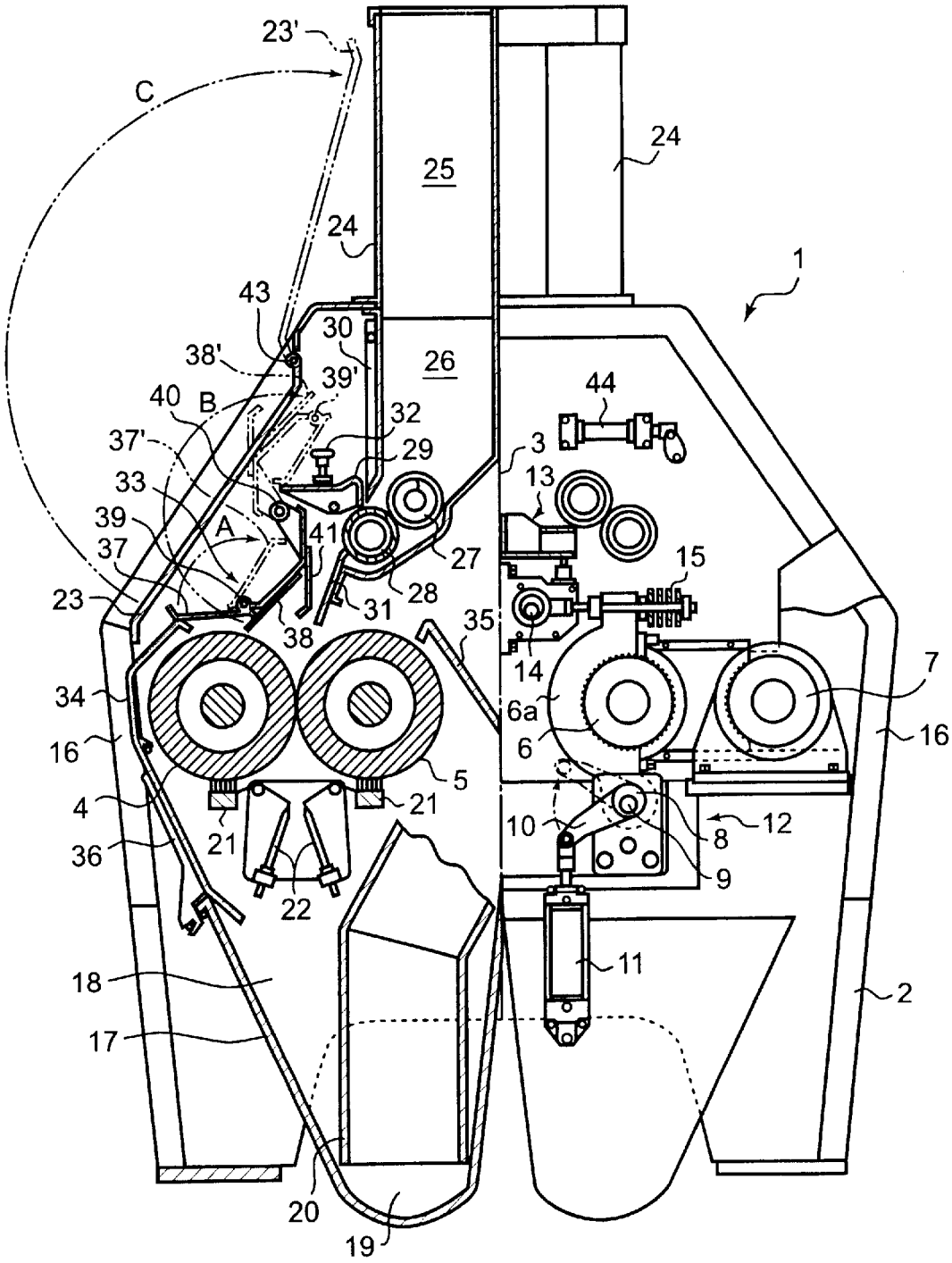
FIG. 2 is a partially cross sectional view showing a flour milling roll machine according to the invention.

FIG. 2 is a partially cross sectional view of a multiple type flour milling roll machine 1 according to the present invention. The roll machine 1 is partitioned into two spaces at the center of a frame 2 by a center partition board 3. Two pairs of rolls 4, 5 are positioned symmetrically with respect to the center partition board 3 in the partitioned spaces. A pair of the rolls 4, 5 are formed in a unity form as a pack with bearings, housings, seals, springs, roll gap adjusting means, etc. being attached integrally thereto, so that an exchange operation of the rolls can be performed quickly.

The detailed structure of the roll pack is explained below. A movable bearing 6 is positioned at a near side of the center partition board 3 in the frame 2 while a fixed bearing 7 is positioned at a far side thereof. A slow-speed roll and a high-speed roll are rotatably attached to the movable bearing 6 and the fixed bearing 7, respectively. The fixed bearing 7 is fixed to the frame 2 by bolts. A divided case 6*a* is formed over a half portion of the movable bearing 6 at a far side of the fixed bearing 7, and fixed detachably to the movable bearing 6 by bolts. Further, a roll gap adjusting means 12 mounted on the frame 2 through a roll open-close eccentric 8 is provided under a bottom portion of the movable bearing 6. A roll open-close air cylinder 11 is connected to an arm 10 attached to a main shaft 9 of the roll open-close eccentric 8. A top portion of the movable bearing 6 is connected, through a roll adjusting eccentric 14 and a spring 15, to a roll gap fine adjusting means 13.

Front walls 16 connected to the upper portion of the frame 2 may be embedded types in which bolts for fixing to the frame 2 are not necessary so that the above-structured roll pack can easily be replaced and exchanged quickly. The front walls may also be hinged types so that the open-close operation of the front walls becomes easier.

A grinding chamber 18 surrounded by a cover 17 under the rolls 4, 5 has its bottom portion constituted as a flowing-out hopper 19. A transporting pipe 20 for transporting the ground stock is faced to the flowing-out hopper 19. Further, brush scrapers 21 which rake the stock adhering to the pair of the rolls 4, 5 are provided in the grinding chamber 18. Each of the brush scrapers 21 is abutted to a surface of each of the rolls 4, 5 by each of supporting members 22.

A front door 23 is provided at a diagonally upper side of the rolls 4, 5, and a stock feeding means is provided between the front door 23 and the center partition board 3. The stock feeding means is constituted by a stock feeding chamber 25 formed by a stock feeding pipe 24, a feeding hopper 26 connected with the stock feeding chamber 25, a pair of front and rear feed rolls 27, 28 for feeding the stock to the rolls 4, 5 in a thin layer state, a feeder gate plate 29 positioned on the front feed roll 28, a guide plate 30 provided on a side wall of the feeding hopper 26, and a guide chute 31 for causing the stock discharged in a thin layer state from the feed roll 28 to flow-down to the main rolls 4, 5 for breaking. A reference numeral 44 depicts an open-close cylinder for the feeder gate plate 29.

Since the pair of the feed rolls 27, 28 are feed rolls for the break stock other than a first break, a screw conveyor is used for the rear feed roll 27 instead of a roll. The feeder gate plate 29 has an adjusting handle 32 which can adjust a flow rate of the stock by adjusting a pushing pressure to the front feed roll 28.

An outer circumference of the pair of the main rolls 4, 5 is covered by a plurality of roll covers. That is, the upper portion of the main rolls 4, 5 is covered by a top cover 33, the side portion of the fixed roll 4 by an outer cover 34, the side portion of the movable roll 5 by an inner cover 35, and the lower portion of the fixed roll 4 by a bottom cover 36.

The top cover 33 is separated into two parts, one being a main roll cover 37 which prevents the touching of the operator's hands to the main rolls 4, 5 and the other being a feed roll cover 38 which prevents the touching of the operator's hands to an intermediate path of the guide chute 31. A first fulcrum axis 39 is provided between the main roll cover 37 and the feed roll cover 38 so that the main roll cover 37 is formed so as to be folded toward the feed roll cover 38 (i.e., foldable toward an arrow A to a reference numeral 37' in FIG. 2). Also, the feed roll cover 38 has a second fulcrum axis 40 at its top portion so that the feed roll cover 38 can swing upward with the main roll cover 37 being folded (i.e., swing toward an arrow B to a reference numeral 38' in FIG. 2). A reference numeral 41 depicts a guide chute cover which covers the guide chute 31 by being extended down from the top of the feed roll cover 38. As specifically shown in FIGS. 4 to 6, a tip portion of the feed roll cover 38 has a finger guard 42 with a plurality of long holes which prevents any objects (e.g. a bag) or operator's hands from being caught between the rolls.

A hinge 43 which connects the top portion of the front door 23 with the frame 2 is attached to the front door 23 provided at a diagonally upper side of the rolls 4, 5. The front door 23 is upwardly swung from the bottom with the hinge 43 as an axis (i.e., swung toward an arrow C to a reference numeral 23' in FIG. 2), so that the front door 23 is formed so as to be self-supported at the upper portion with a completely open state as shown in a dotted line.

An operation of the above-structured machine is explained below.

A polished wheat fed to the stock feeding chamber 25 of the flour milling roll machine 1 by an air transportation is thrown into the gap between the main rolls 4, 5 of a break system through the feed rolls 27, 28 and the guide chute 31 by appropriately opening the feeder gate plate 29 through the feeder gate plate open-close cylinder 44 and the feeder gate adjusting handle 32. The rolls 4, 5 are adjusted to have a predetermined roll gap by the roll gap adjusting means 12. Specifically, the roll open-close air cylinder 11 moves upward so that the arm 10 and the divided case 6*a* are operated, thus, the movable roll 5 moving toward the fixed roll 4 so as to narrow the roll gap.

The polished wheat fed into the rolls 4, 5 is sheared and torn by a difference of the circumferential speed between the fixed roll 4 and the movable roll 5. When the difference of the circumferential speed between the fixed roll 4 and the movable roll 5 is, for example, in a ratio of 2.5 to 1, the shearing efficiency becomes high. The polished wheat which becomes the stock after breaking by the pair of the rolls 4, 5 flows out to the grinding chamber 18 positioned under the rolls 4, 5. Then, the ground wheat is absorbed by the transporting pipe 20, is thrown into a shifter which is not shown, and is classified according to particle sizes.

The surface temperature of the operating pair of the rolls 4, 5 goes up by friction against the stock. Thus, there is an apprehension that the roll is glazed (that is, becomes a loaded roll) because the fine stock powder adheres to the surfaces of the rolls. Therefore, the brush scrapers 21 urged onto the surfaces of the rolls by the supporting members 22 are used to prevent the undesirable adherence of the stock.

After the above breaking procedure, a routine maintenance operation of the flour milling roll machine 1 is carried out. Such maintenance operation aims at an early detection of a trouble of the roll machine 1, a prevention of a damage of the machine, cleaning of the machine, etc. In the present embodiment, a removing process for removing the remaining stock accumulated on the scrapers, the feeder portion and the main roll portion, for which the maintenance is necessary everyday, is explained with reference to the drawings.

Figure 3A:
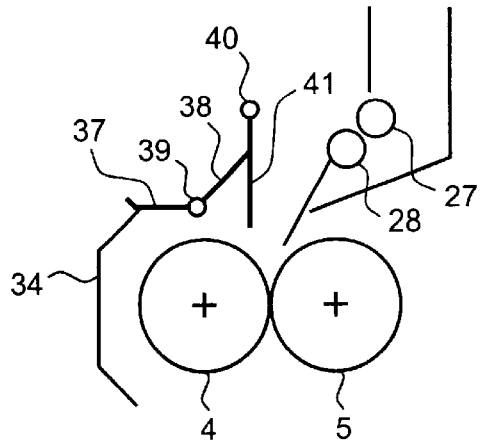
FIG. 3 is a schematic view showing a folding action of a main roll cover and an upward swinging action of a feed roll cover according to the invention.
Figure 3B:
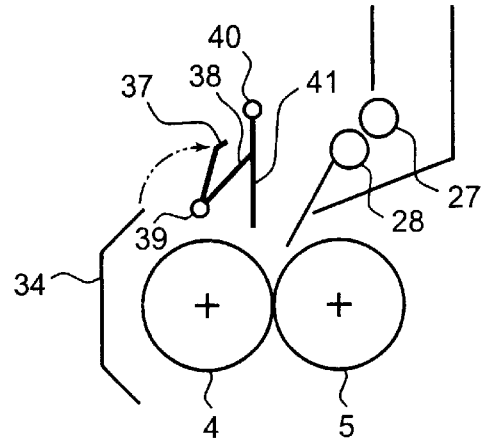
Figure 3C:
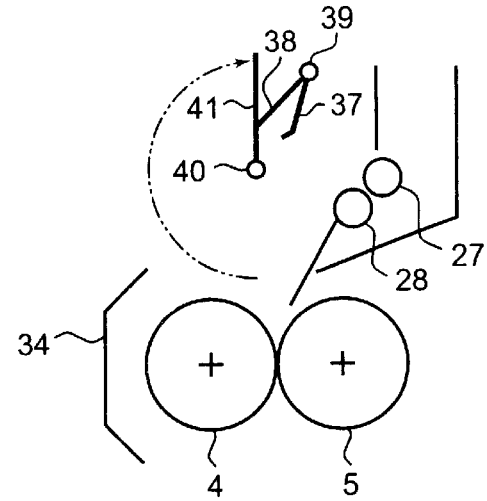
Figure 4:
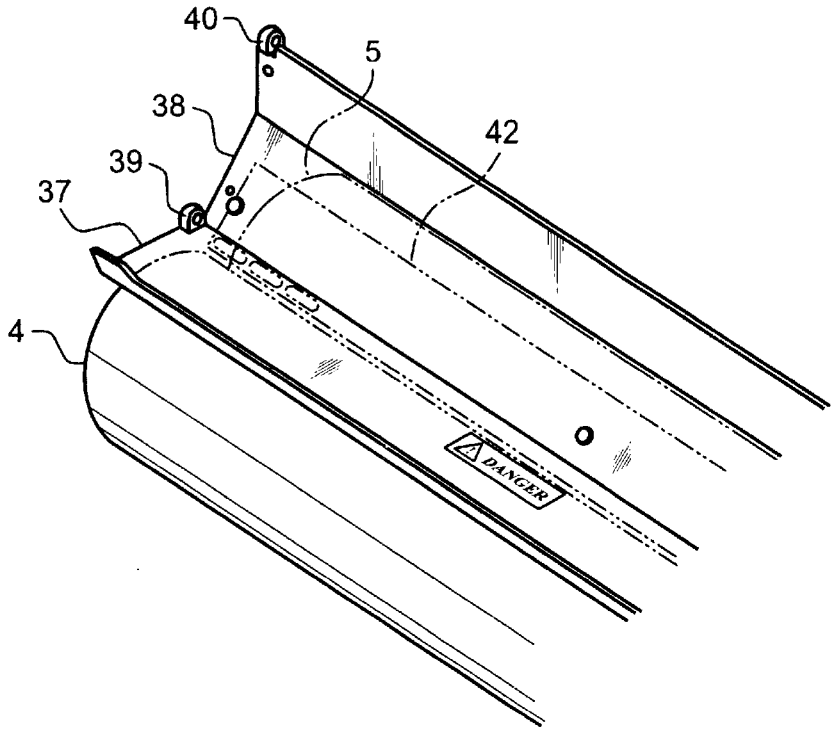
FIG. 4 is a schematic perspective view showing the state in which the rolls are covered with the roll cover, according to the invention.
Figure 5:
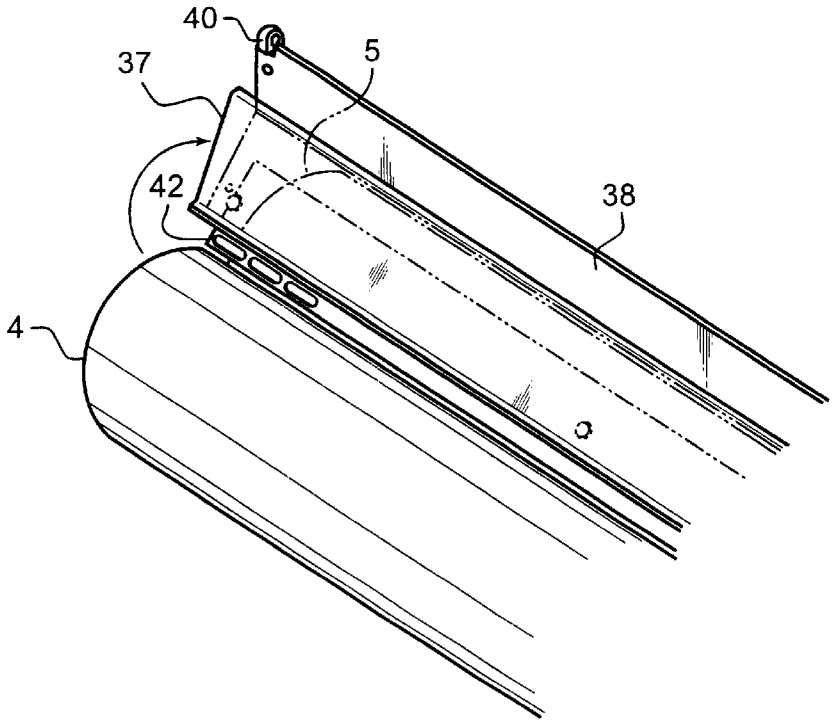
FIG. 5 is a schematic perspective view showing the state in which the main roll cover is folded, according to the invention.

Schematic diagrams illustrating folding movement of a main roll cover and swinging movement of a feed roll cover upwardly are shown in FIGS. 3A–3C. A schematic perspective view illustrating a condition in which the roll cover covers the rolls is shown in FIG. 4. A schematic perspective view illustrating a condition in which the main roll cover is folded is shown in FIG. 5. Also, a schematic perspective view illustrating a condition in which the feed roll cover is swung upwardly is shown in FIG. 6.

For removing the remaining stock in the roll machine 1, first, the bottom edge of the front door 23 in FIG. 2 is upwardly swung from the bottom (i.e., swung toward an arrow C to a reference numeral 23' in FIG. 2), so that the front door 23 is completely opened, fixed, and self-supported at the upper portion. By doing so, the front door 23 can easily be opened with the removing operation of screws being eliminated.

Where the front door 23 is opened, the roll covers 33, 34 covering the rolls 4, 5 are exposed (shown in FIGS. 3A and 4). Also, since the top cover 33 over the main roll 4 is only placed on the outer cover 34, the main roll cover 37 can easily be folded toward the feed roll cover 38 (shown in FIGS. 3B and 5). Further, the feed roll cover 38 can be upwardly swung about the second fulcrum axis 40 with the main roll cover 37 being kept folded (shown in FIGS. 3C and 6).

Figure 6:
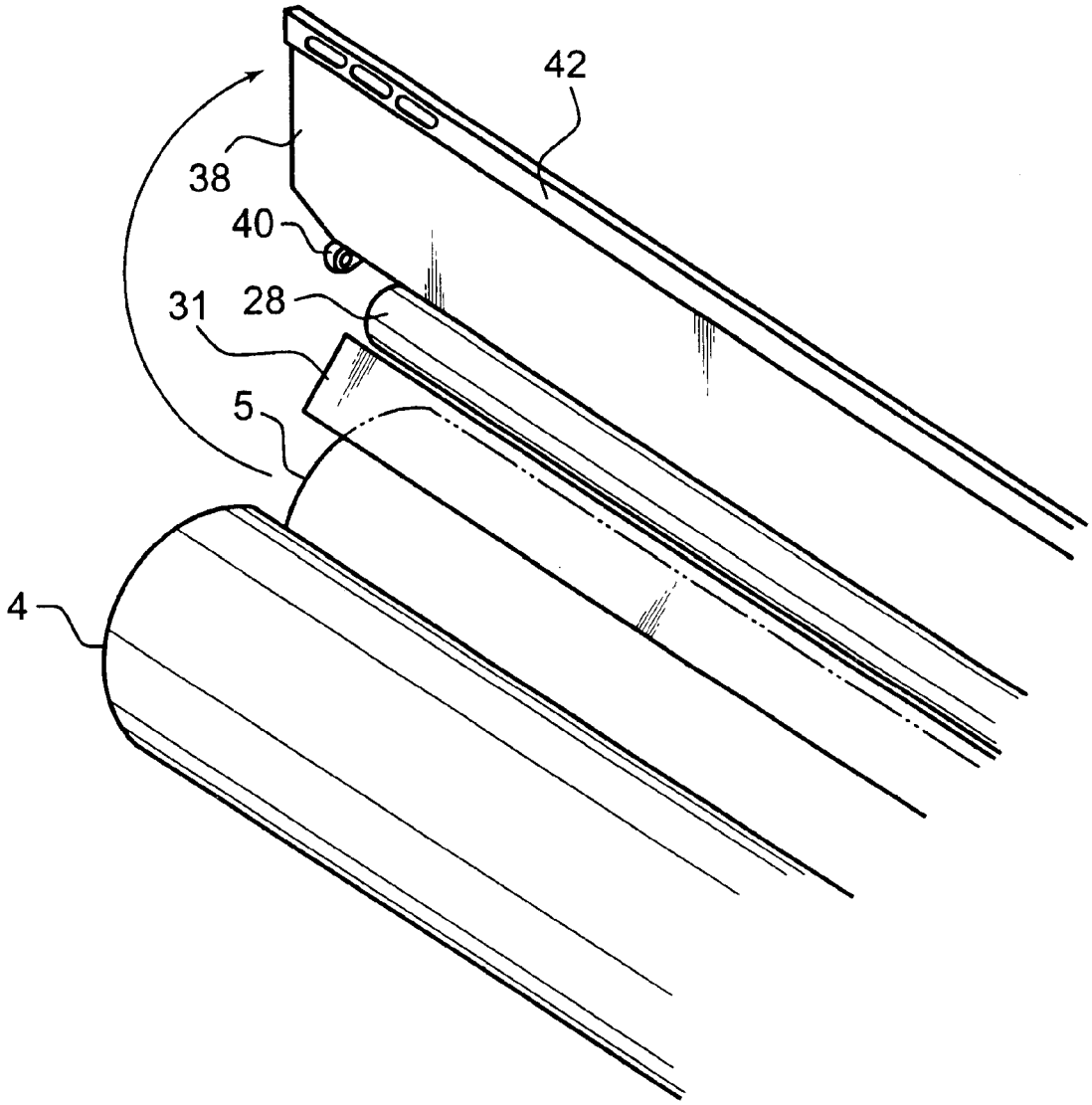
FIG. 6 is a schematic perspective view showing the state in which the feed roll cover is upwardly swung.

Under the condition in which the feed roll cover 38 is upwardly swung as shown in FIGS. 3C and 6, the front feeder roll 28, the main rolls 4, 5 and the guide chute 31 are exposed.

If the stock is accumulated on the peripheral portions of the feeder components, such as the front feeder roll 28, the guide chute 31, and further the feeder gate plate 29, the operator removes the stock by using the cleaning means such as an air compressor and a brush. Also, since the feeder components are fully exposed, the remaining stock, dust, etc. caught in the feeding hopper can easily be removed. For the feeder gate plate 29, the fulcrum axis thereof is inspected and it is inspected whether the feeder gate plate 29 rotates freely without too much play by abrasion. For the main rolls 4, 5, it is inspected whether the roll is glazed by the fine stock powder adhering to the surface thereof. If the roll is glazed, the adjustment of the brush scraper 21 is necessary because the brush scraper then is not functioning properly. Such adjustment is that, first, the embedded type front wall 16 and the bottom cover 36 are removed from the frame 2. If the front wall and/or the bottom cover are the hinged types, the front wall and/or the bottom cover are swung and opened. Next, if the stock is accumulated on the brush scraper 21, this is removed by the air compressor, etc., and the adjustment to the abutted positions between the brush scrapers 21 and the rolls 4, 5 is conducted. If necessary, the brush scraper 21 may be exchanged.

As has been described in the forgoing, according to the invention, the operator opens the front door of the roll machine by which the bottom edge of the front door is upwardly swung from the bottom and is self-supported at the upper portion Then the roll cover covering the pair of the rolls is exposed. From this state, the main roll cover is folded toward the feed roll cover, and further, the feed roll cover is upwardly swung with the main roll cover being folded. In this way, the feeder gate plate, the front feeder roll, the main roll and the guide chute, which are the components of the stock feeding means and are subjected to the routine maintenance operation, are exposed with ease.

If the stock is accumulated on the peripheral portion of the components such as the feeder gate plate, the front feeder roll and the guide chute, the operator removes such stock by the air compressor, the brush, etc. As explained above, no bolts for fixing the front door and the roll cover to the frame are used in the machine of the invention, so that it is not necessary to remove the screws otherwise necessary in the conventional machine, the maintenance can be finished in a short time, and the operation becomes easy.

While the invention has been described in its preferred embodiment, it is to be understood that the words which have been used are words of description rather than limitation and that changes within the purview of the appended claims may be made without departing from the true scope of the invention as defined by the claims.

What is claimed is:

1. A flour milling roll machine comprising:

a machine frame;

at least a pair of rolls within the machine frame and which are driven in a different circumference speed between said paired rolls;

a roll gap adjusting means for adjusting a roll gap between said paired rolls;

a stock feeding means for feeding raw material stock in a thin layer state to the gap between said paired rolls;

a front door for covering an opening in said machine frame located at a diagonally upper side of said paired rolls, said front door having a hinge at its upper edge portion connected to an upper portion of said opening so that it is swung outwardly and upwardly about said hinge and finally is kept at a self-supporting position;

a roll cover divided into a main roll cover for covering over an upper portion of said paired rolls, and a feed roll cover for covering said stock feeding means;

a first fulcrum axis arranged between said main roll cover and one end of said feed roll cover, said main roll cover being foldable on said feed roll cover about said first fulcrum axis; and a second fulcrum axis arranged between the other end of said feed roll cover and an internal predetermined portion of said machine frame, said feed roll cover being swung outwardly and upwardly about said second fulcrum axis with said main roll cover being kept as the folded state and finally being kept as the self-supporting position, wherein, where said front door is opened in the self-supporting position, said roll cover is exposed; where said main roll cover is folded about said first fulcrum axis over said feed roll cover, a part of upper portions of said paired rolls is exposed and, further, where said feed roll cover is swung about said second fulcrum axis and is finally kept at the self-supporting position, the entire upper portions of said paired rolls and said stock feeding means are exposed so that remaining stock accumulated thereon can be removed with ease.

2. The flour milling roll machine according to claim 1, in which said stock feeding means comprises a pair of feed rolls, a feeder gate plate, a guide chute, and a guide chute cover.

3. The flour milling roll machine according to claim 1, in which said feed roll cover has at its tip portion a finger guard with a plurality of elongated holes which prevents operator's hands from being caught between said paired rolls.

4. The flour milling roll machine according to claim 1, which further comprises brush scrapers each of which is abutted to a surface of each of said paired rolls for raking stock adhering to said paired rolls, said brush scrapers being adjusted it said paired rolls are glazed when said paired rolls and said stock feeding means are exposed.

5. The flour milling roll machine according to claim 1, which further comprises a front wall in said machine frame which is opened during maintenance, said front wall having a hinged or hooked portion connected to said machine frame.

6. The flour milling roll machine according to claim 1, which further comprises a bottom cover which covers a lower portion of one of said rolls and which is opened during maintenance, said bottom cover having a hinged or hooked portion connected to said frame.

* * * * *

UNITED STATES PATENT AND TRADEMARK OFFICE

CERTIFICATE OF CORRECTION

PATENT NO. : 6,732,963 B2
DATED : May 11, 2004
INVENTOR(S) : Kasada et al.

It is certified that error appears in the above-identified patent and that said Letters Patent is hereby corrected as shown below:

Column 8,
Line 16, please delete “it” after “adjusted” and insert -- if --.

Signed and Sealed this

Fourth Day of January, 2005

JON W. DUDAS
*Director of the United States Patent and Trademark Office*